US005989064A

United States Patent [19]

Harlan et al.

[11] Patent Number: 5,989,064

[45] Date of Patent: Nov. 23, 1999

[54] BOARD LOCK

[75] Inventors: Tod Harlan, Mechanicsburg; Iosif Korsunsky, Harrisburg, both of Pa.

[73] Assignee: The Whitaker Corporation, Wilmington, Del.

[21] Appl. No.: 09/040,593

[22] Filed: Mar. 18, 1998

[51] Int. Cl.[6] ..... H01R 13/73

[52] U.S. Cl. ..... 439/567

[58] Field of Search ..... 439/567, 571–573

[56] References Cited

U.S. PATENT DOCUMENTS

| | | | |
|---|---|---|---|
| 3,954,242 | 5/1976 | Yoda | 248/223 |
| 4,435,031 | 3/1984 | Black et al. | 339/17 C |
| 4,907,987 | 3/1990 | Douty et al. | 439/571 |
| 5,074,807 | 12/1991 | Parmer | 439/553 |
| 5,145,407 | 9/1992 | Obata et al. | 439/567 |
| 5,154,634 | 10/1992 | Brown et al. | 439/553 |
| 5,192,228 | 3/1993 | Collins et al. | 439/567 |
| 5,336,111 | 8/1994 | Thrush et al. | 439/567 |
| 5,387,115 | 2/1995 | Kozel et al. | 439/157 |
| 5,415,565 | 5/1995 | Mosquera | 439/567 |
| 5,419,713 | 5/1995 | Northey | 439/329 |
| 5,462,454 | 10/1995 | Kramer et al. | 439/571 |
| 5,478,257 | 12/1995 | Cachina et al. | 439/567 |
| 5,551,891 | 9/1996 | Huss, Jr. | 439/567 |
| 5,664,965 | 9/1997 | Clark et al. | 439/567 |

*Primary Examiner*—Gary Paumen
*Attorney, Agent, or Firm*—Salvatore Anastasi

[57] ABSTRACT

The present invention is related to an improved boardlock 10 for use in an electrical connector 40. The boardlock 10 features a plurality of arms 16, 18, 20 ,22 extending from a housing securing portion 12. The arms 16, 18, 20, 22 are joined together by integral neck portions 24, 26, 28 which act as pivot points to allow the boardlock 10 to be insertable into a variety of circuit board openings.

8 Claims, 2 Drawing Sheets

BOARD LOCK

FIELD OF THE INVENTION

This invention is related to electrical connectors and more particularly to an improved Board Lock for use in such connectors.

BACKGROUND OF THE INVENTION

Board mounted electrical connectors are typically connected to a printed circuit board either by surface mount technology (SMT) or soldered through hole connections which may be accomplished through wave soldering techniques. In either instance, it is necessary to first accurately position the electrical connector so that its contacts engage complimentary contact surfaces on the printed circuit board, then temporarily hold the electrical connector in place, and finally form the electrical connections by SMT, wave soldering, or any other suitable method.

The step of temporally holding the connector in place over the contact interface is typically accomplished by a holding device which is incorporated into the housing of the electrical connector. These holding devices may be integrally molded into the housing or may be separate metal boardlocks which are fixed to the housing as shown in U.S. Pat. No. 5,336,111 by Roger L. Thrush et al. These boardlocks serve several purposes. First, they extend from the mounting face of the housing beyond the contact tails so that they engage openings in the printed circuit board first to insure that the connector is properly aligned for the tails to pass through the contact openings in the circuit board without being damaged. Secondly, once inserted into the openings of the circuit board, the boardlocks serve to hold the connector such that the mounting face of the housing remains flush or in engagement with the printed circuit board along its entire length.

The patent by Roger Thrush et al. teaches such a boardlock which serves both to align the electrical connector with the openings of the printed circuit board and to hold the printed circuit board in place during the soldering process.

These boardlocks are typically designed for a specific board opening with a variation of plus or minus 0.001 inch. As a result, a different boardlock is required for each different board opening. If such a boardlock is utilized in a board opening which is smaller than that specified, the insertion force required to secure the boardlock increases undesirably. The board openings however are not standardized and therefore each application will require a different geometry board lock to achieve the necessary retention forces and the desired insertion forces for the connector.

A problem exits in that each connector family must be designed with several different boardlocks in order to accommodate end applications having different diameter boardlock receiving openings in the circuit boards. While the board lock shown by Thrush et al. would fit into several different size board openings because it is compressible about two end points, the insertion force required to insert the connector becomes prohibitively high as the board opening is decreased.

It is therefore desirable to provide a versatile boardlock having the rigidity necessary for connector alignment and handling purposes and the flexibility to be inserted into several different size board openings while minimizing the range of insertion force necessary to accommodate the different size board openings.

SUMMARY

It is an object of this invention to provide an improved board lock having overall rigidity for properly positioning an electrical connector over a printed circuit board contact interface while having the ability to be inserted into a range of board lock receiving openings on the printed circuit board while minimizing the range of insertion force necessary.

This and other objects have been achieved by providing a stamped boardlock having a plurality of ridged arms joined by reduced neck sections which act as pivot points.

BRIEF DESCRIPTION OF THE DRAWINGS

The invention will now be described by way of example with reference to the accompanying figures of which.

DETAILED DESCRIPTION OF THE EMBODIMENT

Figure 1:
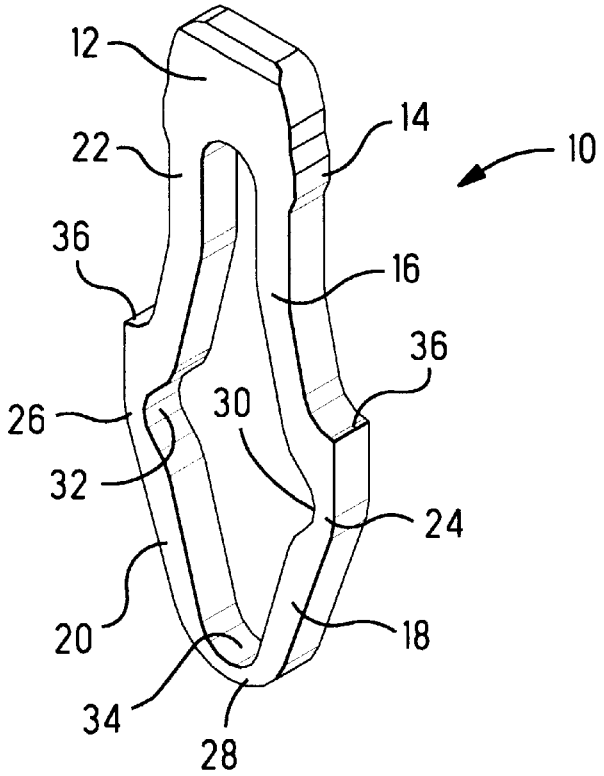
FIG. 1 shows a three dimensional view of the board lock according to the present invention.
Figure 2:
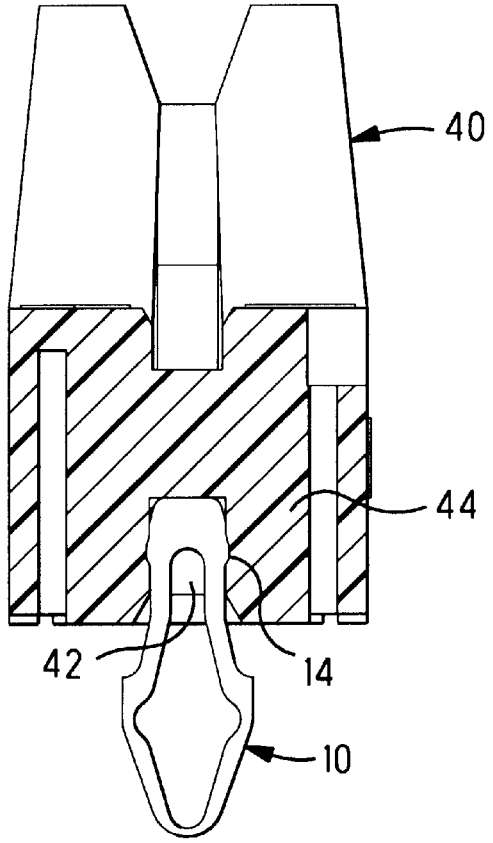
FIG. 2 shows a cross sectional view of a boardlock assembled to an electrical connector.

The invention will now be described first with reference to FIG. 1. This figure shows a three dimensional view of a boardlock 10 according to the present invention. The boardlock 10 is stamped from sheet material and is profiled to have a housing retention section 12 for securing the boardlock 10 into a housing 44 of an electrical connector 40 (FIG. 2). A pair of barbs 14 are disposed along opposite sides thereof. A first pair of arms 16, 22 extend from the housing retention section 12 at an angle from each other. These first pair of arms 16, 22 extend to opposed neck portions 24, 26. The neck portions 24, 26 are defined by curved surfaces 30, 32 which are disposed along an interior section of the boardlock 10. These curved surfaces extend into the end of each arm 16,22. The neck portions 24, 26 are therefore thinner than the arms 16, 22. A second pair of arms 18, 20 extend each from respective neck portions 24, 26 at an angle toward each other. A third neck portion 28 joins the second pair of arms 18, 20. This neck portion 28 is similarly defined by a curved surface 34 disposed along the interior section of the boardlock 10 which similarly extend into the ends of each arm 18, 20. The neck 28 is thinner that the arms 18,20. A pair of shoulders 36 extend from each of the first pair of arms 16, 22 on the outside of the boardlock 10 in the vicinity of the neck portions 24, 26. This boardlock 10 is preferably stamped from a sheet of brass having a thickness of 0.018 inch. However, depending upon the desired range of board openings 62 which must be accommodated, this boardlock 10 may be formed of other suitable materials such as aluminum or stainless steel having an appropriate thickness.

Assembly of the boardlock 10 to an electrical connector 40 will now be described in greater detail with reference to FIG. 2. The boardlock 10 is simply inserted into a boardlock receiving opening 42 of an insulative housing 44. The insulative housing 44 is typically formed of a plastic material. The boardlock 10 is inserted into the boardlock opening 42 such that the housing retention section 12 is disposed in the boardlock receiving opening 42 and the barbs 14 skive into the edges of the boardlock receiving opening 42 to secure the boardlock 10 into the opening 42.

Figure 3:
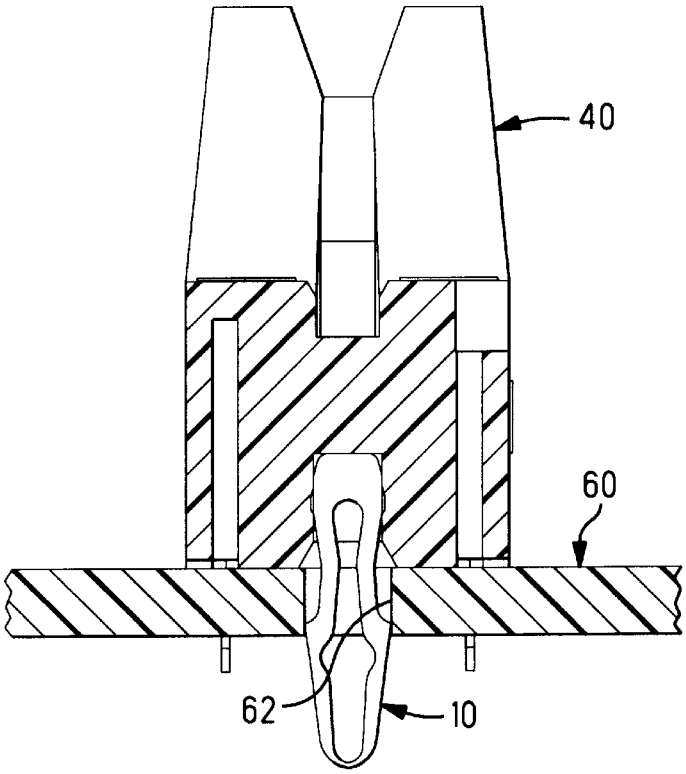
FIG. 3 shows a cross sectional view similar to that of FIG. 2 wherein the electrical connector is assembled to a printed circuit board at a boardlock opening.

The boardlock 10 and electrical connector 40 may then be inserted into a printed circuit board opening 62 such that the arms 18, 20,16, 22 enter the printed circuit board opening 62 as shown in FIG. 3. Here it can be seen that the electrical connector 40 is positioned over a printed circuit board 60. The boardlock 10 compresses to secure itself into the opening 62 by exerting an outward force on the walls of the opening 62. It can also be seen that the boardlock 10 flexes at each of the neck portions 24, 26,28 to achieve the compression. Each of the neck portions 24, 26, 28 act as a pivot point during the compression. It should be noted here that the boardlock 10 is first elastically deformed as it enters the opening 62. It then experiences plastic deformation as it is urged further intothe opening 62 to its final securing position as shown in FIG. 3. Since the boardlock is plastically deformed, its force deflection characteristics are consistent and determinable Once plastic deformation begins, small increments of additional insertion force are required in order to achieve further destination.

Figure 4:
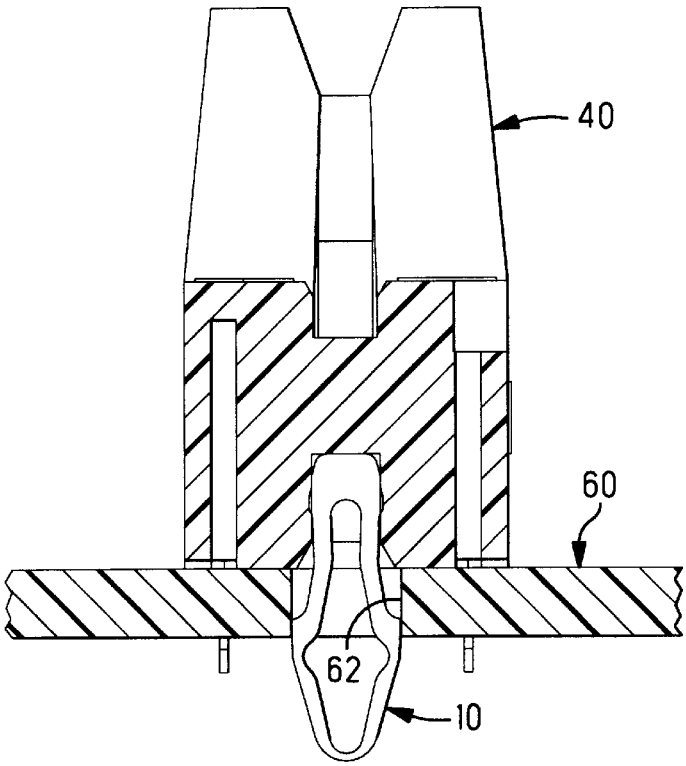
FIG. 4 shows a cross sectional view similar to that of FIG. 3 wherein the electrical connector is assembled to a printed circuit board having a board lock opening which is larger than that shown in FIG. 3.

Test results show that this boardlock 10 is insertable into openings varied in size between 0.080 inch and 0.101 inch while achieving a range of retention forces between about 0.5 and 0.7 lbs. These test scenarios can be seen in FIGS. 3 and 4. FIG. 3 represents the boardlock 10 inserted into a 0.080 inch opening 62 and FIG. 4 represents the boardlock 10 inserted into a 0.101 inch opening 62. Insertion forces for these opening sizes varied between about 1.4 lbs. for the 0.101 inch opening and 2.1 lbs for the 0.080 inch opening. These test results show that this boardlock 10 is capable of consistent retention forces in variable opening sizes while maintaining a narrow range of required insertion forces.

An advantage of this invention is that since the boardlock 10 is designed to operate in the plastic deformation region of the force deflection characteristic, small increments of additional insertion force are required in order to achieve additional compression for smaller opening 62 sizes. Therefore this boardlock 10 exhibits consistent retention forces in a variety of opening sizes which minimizing the range of insertion force required.

The boardlock has an additional advantage in that it provides a structure which is rigid enough to withstand handling and alignment processes while being flexible enough to accommodate various size board openings.

An additional advantage is that the boardlock can function in boards having various thicknesses. Since the shoulders 36 reside within the thickness of the board opening upon full insertion, the board thickness can vary and the same retention characteristics will result. This is because the boardlock does not rely of engagement of the shoulder with the underside of the board opening underside to achieve retention. Instead retention is achieved by the virtue of the fact that the shoulders engage the walls of the board opening.

It should be understood by those reasonably skilled in the art that while the invention has been shown here with reference to an embodiment, various changes in geometry would be apparent while remaining within the scope of the invention. For example the thickness of each neck portion could be varied. Similarly, the ratio of thickness of each arm to the thickness of the neck portions could be varied. Also the thickness of the neck portions could be different relative to each other. Also similar pivot points could be achieved by structures different from the neck portions. The scope of the invention is therefore intended to be limited only by the following claims.

We claim:

1. A boardlock for use in an electrical connector comprising:

a housing retention section for securing the boardlock to an insulative housing;

a first pair of arms extending from the retention section to a pair of integral neck portions disposed at respective ends of each arm opposite the retention section;

a second pair of arms extending from the integral neck portions towards each other; and, a third integral neck portion joining the second pair of arms to each other; wherein each neck portion is defined by a curved surface on an inside of the boardlock.

2. The boardlock as recited in claim 1 wherein each neck portion is defined by a curved surface on an inside of the boardlock.

3. An electrical connector having a insulative housing and a plurality of electrical contacts extending from the insulative housing for mating with contact sites on a printed circuit board, the electrical connector further comprising;

a boardlock being insertable into an opening in the insulative housing, the boardlock having a securing portion-profiled to cooperate with the opening, four retention arms extending from the securing portion and being connected with each other by a plurality of integral neck portions being dimensioned to be thinner than the arms such that they act as bendable portions upon compression of the board lock.

4. A board lock for use with an electrical connector having a housing securing portion, a first pair of arms extending from the housing securing portion, and a second pair of arms connected to the first pair of arms at one end and to each other at an opposite end, the board lock being characterized in that:

each of the arms are joined to each other by a neck having a smaller planar dimension than a planar dimension of the arms.

5. A boardlock comprising:

a housing retention section;

a plurality of arms extending from the housing retention section, and;

a plurality of pivot points joining the plurality of arms to each other, each pivot point being defined by a curved surface which extends into an end of a respective arm.

6. A boardlock comprising:

retention means for securing the boardlock into a housing of an electrical connector, a plurality of rigid beams extending from the housing retention means, and;

pivot means connecting each of the beams to each other for allowing the beams to pivot relative to each other.

7. The boardlock as recited in claim 6 wherein the retention means comprises at least one barb formed on an edge of a retention section.

8. The boardlock as recited in claim 6 wherein the pivot means comprises a neck formed of a material which is thinner than a material of the rigid beams.

* * * * *